US012181239B2

(12) United States Patent
Sundquist

(10) Patent No.: US 12,181,239 B2
(45) Date of Patent: Dec. 31, 2024

(54) ARRANGEMENT AND METHOD FOR BALANCING A GUN BARREL OF A VEHICLE MOUNTED WEAPON SYSTEM

(71) Applicant: Bae Systems Hägglunds Aktiebolag, Örnsköldsvik (SE)

(72) Inventor: Rikard Sundquist, Arnäsvall (SE)

(73) Assignee: BAE Systems Hägglunds Aktiebolag, Örnsköldsvik (SE)

( * ) Notice: Subject to any disclaimer, the term of this patent is extended or adjusted under 35 U.S.C. 154(b) by 276 days.

(21) Appl. No.: 17/623,835

(22) PCT Filed: Jun. 25, 2020

(86) PCT No.: PCT/SE2020/050664
§ 371 (c)(1),
(2) Date: Dec. 29, 2021

(87) PCT Pub. No.: WO2021/002793
PCT Pub. Date: Jan. 7, 2021

(65) Prior Publication Data

US 2022/0252370 A1 Aug. 11, 2022

(30) Foreign Application Priority Data

Jul. 2, 2019 (SE) ..... 1950833-2

(51) Int. Cl.
*F41A 27/30* (2006.01)

(52) U.S. Cl.
CPC ..... *F41A 27/30* (2013.01)

(58) Field of Classification Search
CPC ..... F41A 27/28; F41A 27/24
See application file for complete search history.

(56) References Cited

U.S. PATENT DOCUMENTS 1,518,262 A * 12/1924 Joyce ..... F41A 27/24
89/41.12
1,543,263 A * 6/1925 Methlin ..... F41A 27/08
89/37.02

(Continued)

FOREIGN PATENT DOCUMENTS

DE 3241665 A1 5/1984
DE 3245880 A 6/1984

(Continued)

OTHER PUBLICATIONS

International Search Report and Written Opinion for International Application No. PCT/SE2020/050664 mailed on Sep. 2, 2020, 16 pages.

(Continued)

*Primary Examiner* — Derrick R Morgan
(74) *Attorney, Agent, or Firm* — Morrison & Foerster LLP

(57) ABSTRACT

The present invention relates to an arrangement (A) for balancing a gun barrel (20) of a vehicle mounted weapon system (C). The weapon system comprises the gun barrel (20) mounted to a turret (10) via a weapon cradle (30). The weapon cradle (30) is arranged to allow elevation movement of the gun barrel (20) about an elevation axis (Z1). Said arrangement (A) comprises a suspension system (S) configured to provide a torque opposing imbalance of the gun barrel (20). The arrangement further comprises an adjustment device (50; 150) for automatically adjusting the torque provided by the suspension system (S) based on imbalance of the gun barrel (20) so as to dynamically counteract imbalance of the gun barrel (20). The invention also relates to a vehicle with an arrangement according to the present invention.

7 Claims, 7 Drawing Sheets

(56) References Cited

U.S. PATENT DOCUMENTS 2,352,086 A 6/1944 Eberhard
2,356,152 A * 8/1944 Edwards ..... F41A 27/28 89/37.17
2,364,425 A * 12/1944 Corte ..... F41A 27/18 89/37.17
2,392,851 A * 1/1946 Kasch ..... F41A 27/06 89/41.22
2,404,090 A * 7/1946 Pontius ..... F41A 27/28 318/82
2,414,924 A * 1/1947 Borden ..... F41A 27/28 318/632
2,456,522 A * 12/1948 McLaren et al. ..... F41A 27/28 318/257
2,457,532 A * 12/1948 Cunningham ..... F41A 27/28 318/632
2,480,136 A * 8/1949 Holstein ..... F41A 27/20 475/290
2,515,248 A * 7/1950 McCoy ..... G01S 13/68 318/158
2,548,884 A * 4/1951 Hartman ..... F41A 27/28 318/595
2,586,817 A * 2/1952 Harris, Jr. ..... G05D 3/18 89/41.21
2,628,535 A * 2/1953 Jackson, Jr. ..... F41A 27/28 89/134
2,660,794 A * 12/1953 Goertz ..... F41G 3/06 235/404
2,703,039 A * 3/1955 White ..... F41G 5/00 246/33
3,041,518 A * 6/1962 Bengt ..... F41G 5/06 235/404
3,207,497 A 9/1965 Schoonover
3,262,522 A 7/1966 Johnson et al.
3,288,030 A * 11/1966 Lind ..... G06G 7/78 235/404
3,405,599 A 10/1968 Reid et al.
3,456,511 A * 7/1969 Craig ..... G05D 3/1445 74/5.6 R
3,662,647 A * 5/1972 King ..... F41A 23/28 89/40.11
3,766,826 A * 10/1973 Salomonsson ..... F41A 27/06 235/404
3,854,378 A * 12/1974 Vogel ..... F41A 27/28 89/41.09
4,326,447 A * 4/1982 Kauer ..... F41G 5/24 192/21
4,382,216 A * 5/1983 Joseph ..... G05D 3/1463 318/648
4,501,188 A * 2/1985 Wroble ..... F41G 5/14 89/41.02
4,501,190 A * 2/1985 Hobson ..... F41A 27/24 74/440
4,970,938 A * 11/1990 Allais ..... F41G 1/3935 89/36.14
5,014,594 A 5/1991 Muhlhausen et al.
5,178,405 A 1/1993 Brandstadter
5,413,028 A * 5/1995 Ng ..... F41G 3/323 89/41.09
5,685,527 A * 11/1997 Harbali ..... B60G 11/181 280/124.101
8,191,911 B1 * 6/2012 Reynolds ..... B60G 3/20 280/124.13
9,568,267 B2 * 2/2017 Lung ..... F41A 23/24
9,746,270 B1 * 8/2017 Rose ..... F41A 27/20
10,890,407 B1 * 1/2021 Archer ..... F41G 5/14
2005/0056111 A1 * 3/2005 Exely ..... F16F 15/10 74/471 R
2005/0263000 A1 * 12/2005 Hill ..... F41A 27/30 89/136
2007/0144338 A1 * 6/2007 Gerstadt ..... F41A 27/28 89/41.09
2008/0157448 A1 * 7/2008 Preukschat ..... B60G 17/025 267/285
2011/0030544 A1 * 2/2011 Hodge ..... F41A 27/06 250/504 R
2013/0068584 A1 * 3/2013 Lim ..... F41G 3/165 192/103 R
2015/0267989 A1 * 9/2015 Hobson ..... F41A 27/30 89/37.12
2015/0300765 A1 * 10/2015 Choi ..... F41G 5/24 89/6.5

FOREIGN PATENT DOCUMENTS

EP 3399273 A1 11/2018
EP 2875307 B1 3/2019
FR 3052550 A1 12/2017
GB 2433107 A 6/2007
JP H01-278815 A 11/1989
RU 2069634 C1 11/1996
SU 1562219 A1 5/1990
WO WO-8606157 A1 10/1986
WO WO-2013161006 A1 10/2013

OTHER PUBLICATIONS

Swedish Search Report for Swedish Application No. SE1950833-2 mailed on Jan. 16, 2020, 9 pages.
Extended European Search Report and Opinion mailed for European Patent Application No. 20835417.5 mailed on Jun. 13, 2023, 7 pages.
Search Report received for Russian Patent Application No. 2022101934 mailed on Oct. 13, 2023, 4 pages. English translation.

* cited by examiner

ARRANGEMENT AND METHOD FOR BALANCING A GUN BARREL OF A VEHICLE MOUNTED WEAPON SYSTEM

CROSS REFERENCE TO RELATED APPLICATIONS

This application is a national stage application under 35 U.S.C. § 371 of International Application No. PCT/SE2020/050664, filed internationally on Jun. 25, 2020, which claims priority to SE 1950833-2, filed Jul. 2, 2019, the entire contents of each are incorporated by reference herein.

TECHNICAL FIELD

The present invention relates to an arrangement for balancing a gun barrel of a vehicle mounted weapon system. The present invention also relates to a method for balancing a gun barrel of a vehicle mounted weapon system. The present invention also relates to a vehicle.

BACKGROUND ART

Combat vehicles such as infantry fighting vehicles or tanks may be equipped with a weapon system associated with a turret, wherein the weapon system comprises a gun barrel attached to the turret via a weapon cradle. To control orientation of the gun barrel, the gun barrel is arranged to be moved by means of rotation of the turret and wherein elevation of the gun barrel is arranged to be controlled by a motor of the weapon cradle.

In order to maintain a precise orientation/alignment of the gun barrel one important aspect is the balancing of the gun barrel. This is particularly important when the vehicle moves in uneven terrain.

There is thus a need to provide an arrangement for improved balancing of the gun barrel.

OBJECTS OF THE INVENTION

An object of the present invention is to provide an arrangement for balancing a gun barrel of a vehicle mounted weapon system.

Another object of the present invention is to provide a method for balancing a gun barrel of a vehicle mounted weapon system.

Another object of the present invention is to provide a vehicle comprising such an arrangement.

SUMMARY OF THE INVENTION

These and other objects, apparent from the following description, are achieved by an arrangement and a method for balancing a gun barrel of a vehicle mounted weapon system, and a vehicle, as set out in the appended independent claims. Preferred embodiments of the suspension arrangement for a tracked a vehicle are defined in appended dependent claims.

Specifically an object of the invention is achieved by an arrangement for balancing a gun barrel of a vehicle mounted weapon system. The weapon system comprises the gun barrel mounted to a turret via a weapon cradle. The weapon cradle is arranged to allow elevation movement of the gun barrel about an elevation axis. Said arrangement comprises a suspension system configured to provide a torque opposing imbalance of the gun barrel. The arrangement further comprises an adjustment device for automatically adjusting the torque provided by the suspension system based on imbalance of the gun barrel so as to dynamically counteract imbalance of the gun barrel.

The arrangement according to the present disclosure comprises an adjustment device for adjusting the torque provided by the suspension system based on imbalance of the gun barrel so as to counteract imbalance of the gun barrel.

Hereby balance of the gun barrel may be controlled in an accurate and efficient way. By thus automatically adjusting the torque provided by the suspension system based on imbalance of the gun barrel due to e.g. weight of the gun barrel and/or inclination of the vehicle, dynamic counteraction of the imbalance of the gun barrel may be efficiently provided. Thus, hereby a dynamic counteraction of the imbalance of the gun barrel may be obtained, as opposed to having a static torque. Thus, operation gun barrel during drive of the vehicle e.g. in uneven terrain may be improved.

Automatic adjustment of the torque provided by the suspension system based on imbalance of the gun barrel means that if there is a change of the gun barrel so that the gun barrel is not balanced, i.e. there is an imbalance of the gun barrel, the adjustment device is configured to adjust the torque for counteracting the imbalance. Thus, the adjustment device provides a dynamic adjustment of the torque provided by the suspension based on imbalance of the gun barrel.

According to an embodiment of the arrangement the suspension system comprises a torsion bar having a first end portion configured to be fixedly attached to the turret and a second end portion configured to be connected to the weapon cradle so as to provide said torque. By thus utilizing a torsion bar for providing the torque opposing imbalance of the gun barrel, said automatic adjustment is facilitated. The adjustment device is thus configured to adjust the torque on the torsion bar based on imbalance of the gun barrel so as to counteract imbalance of the gun barrel.

According to an embodiment of the arrangement the adjustment device comprises an actuator unit configured to provide said automatic adjustment of the torque provided by the suspension system based on sensor data indicative for current imbalance of the gun barrel. According to an embodiment of the arrangement the actuator unit is configured to provide said adjustment of the torque provided on the torsion bar based on sensor data indicative for current imbalance of the gun barrel. By thus utilizing an actuator unit and providing said automatic adjustment based on sensor data indicative for current imbalance of the gun barrel said automatic adjustment may be efficiently and accurately provided and controlled. Hereby efficient and accurate control of counteracting imbalance of the gun barrel is obtained. Thus, dynamic counteraction of imbalance of the gun barrel is hereby efficiently and automatically controlled. An actuator unit may be any suitable unit for providing said automatic adjustment, e.g. an electric actuator, e.g. any suitable electric motor, servomotor, step motor or the like.

According to an embodiment of the arrangement the sensor data indicative for current imbalance of the gun barrel comprises energy required by drive arrangement for operating the weapon cradle and/or current elevation of the gun barrel and/or current roll and pitch of the vehicle and/or current weight of gun barrel. By thus basing the automatic adjustment on one or more of said sensor data, efficient and accurate automatic adjustment is facilitated. Hereby efficient and accurate control of counteracting imbalance of the gun barrel is obtained.

According to an embodiment the arrangement comprises a control device configured to control the adjustment device based on said sensor data indicative for current imbalance of the gun barrel. The control device is configured to control the actuator unit based on said sensor data indicative for current imbalance of the gun barrel. The control device is according to an aspect of the present disclosure configured to receive and process said sensor data. The control device is according to an aspect of the present disclosure operably connected to the actuator unit. Hereby efficient control of the automatic adjustment is facilitated. Hereby efficient and accurate control of counteracting imbalance of the gun barrel is obtained.

According to an embodiment of the arrangement the adjustment device comprises a progressive linkage configuration configured to provide said automatic adjustment of the torque provided by the suspension system based on elevation movement of the gun barrel. Hereby efficient and accurate automatic adjustment may be provided mechanically, i.e. without any actuator unit/electronic connection.

According to an embodiment of the arrangement the progressive linkage configuration comprises a first non-circular gear attached to the torsion bar and a second non-circular gear attached to the weapon cradle in connection to the elevation axis and configured to transmit torque to the first non-circular gear during elevation movement of the gun barrel. Hereby efficient and accurate automatic adjustment may be provided mechanically, i.e. without any actuator unit/electronic connection.

Specifically an object of the invention is achieved by a method performed by a control device for balancing a gun barrel of a vehicle mounted weapon system. The weapon system comprises the gun barrel mounted to a turret via a weapon cradle. The weapon cradle is arranged to allow elevation movement of the gun barrel about an elevation axis. The method comprises the step of providing a torque opposing imbalance of the gun barrel by means of a suspension system. The method further comprises the step of: automatically adjusting the torque provided by the suspension system based on imbalance of the gun barrel so as to dynamically counteract imbalance of the gun barrel.

According to an embodiment of the method the suspension system comprises a torsion bar having a first end portion configured to be fixedly attached to the turret and a second end portion configured to be connected to the weapon cradle so as to provide said torque.

According to an embodiment the method comprises the step of: determining current imbalance of the gun barrel; and providing said automatic adjustment by means of an actuator unit based on sensor data from the thus determined imbalance of the gun barrel.

According to an embodiment of the method the step of determining current imbalance of the gun barrel comprises one or more of the steps of: determining energy required by a drive arrangement for operating the weapon cradle;

detecting current elevation of the gun barrel; detecting current roll and pitch of the vehicle; and, determining current weight of gun barrel.

The method according to the present disclosure has the advantages according to the corresponding arrangement as set out herein.

Specifically an object of the invention is achieved by a vehicle comprising an arrangement for balancing a gun barrel of a vehicle mounted weapon system as set out herein.

According to an embodiment the vehicle is a tracked vehicle. According to an embodiment the vehicle is a combat vehicle.

BRIEF DESCRIPTION OF THE DRAWINGS

For a better understanding of the present invention reference is made to the following detailed description when read in conjunction with the accompanying drawings, wherein like reference characters refer to like parts throughout the several views, and in which.

DETAILED DESCRIPTION

Herein the term "link" refers to a communication link which may be a physical connector, such as an optoelectronic communication wire, or a non-physical connector such as a wireless connection, for example a radio or microwave link.

Herein the term "actuator unit" refers to any unit suitable for providing automatic adjustment of torque provided by a suspension system, e.g. comprising a torsion bar, based on sensor data indicative for current imbalance of a gun barrel of a vehicle mounted weapon system. The term "actuator unit" may thus refer to any suitable actuator unit for facilitating adjustment of torque provided by a torsion bar of a suspension system based on sensor data indicative for current imbalance of such a gun barrel. The term "actuator unit" may e.g. comprise an electric actuator, e.g. an electric motor, a servomotor, a step motor or the like. The term "actuator unit" may refer to any suitable device, i.e. actuator unit, which is operably connectable to a control device and which is controllable by means of said control device so as to provide adjustment of torque provide by a suspension system, e.g. comprising a torsion bar. The control device may be configured to receive and process sensor data indicative for current imbalance of a gun barrel of a vehicle mounted weapon system.

Herein the term "dynamically" in connection to "dynamically counteract imbalance of the gun barrel" refers to the counteraction of the imbalance of the gun barrel being actively obtained due to the adjustment of torque provided by suspension system, i.e. adjustment of torque on torsion bar of suspension system, based on imbalance of gun barrel. Adjustment of torque provided by suspension system, i.e. adjustment of torque on torsion bar of suspension system, based on imbalance of gun barrel may thus be referred to a dynamic adjustment of torque, as apposed having a static torque set on the suspension system, e.g. torsion bar.

Herein the term "automatically adjusting" in connection to "automatically adjusting the torque provided by the suspension system based on imbalance of the gun barrel" may refer to an adjustment performed by means of an adjustment device when there is an imbalance. According to an aspect such an adjustment device comprises an actuator unit which is configured to perform such automatic adjustment based on sensor data about current imbalance of the gun barrel. Automatic adjustment may be obtained mechanically be means of an adjustment device comprising a linkage configuration.

Figure 1A:
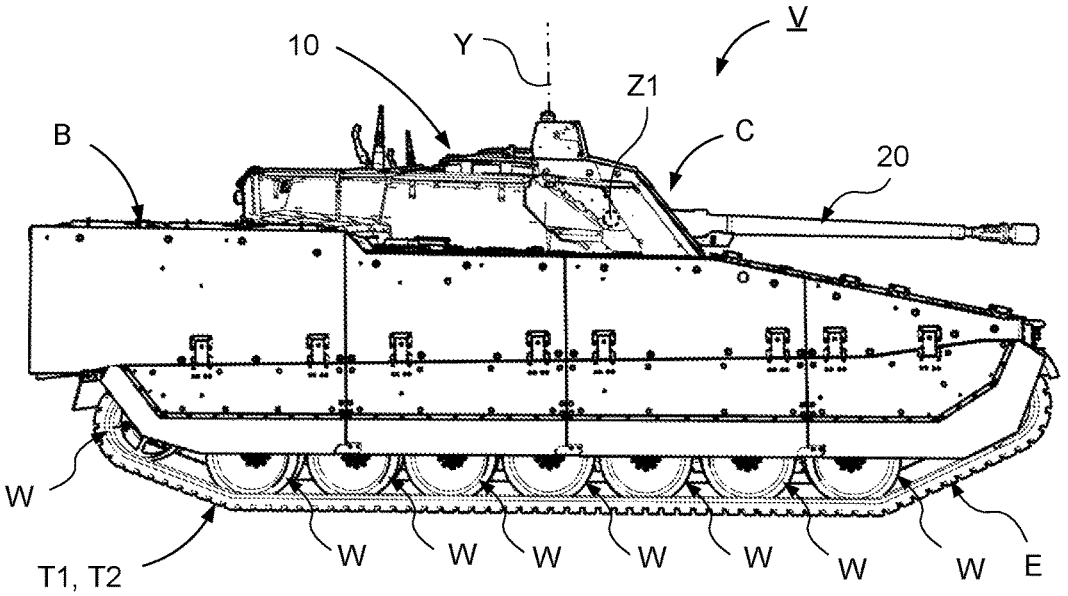
FIG. 1 a schematically illustrates a side view of a tracked vehicle according to an embodiment of the present disclosure.
FIG. 1*b* schematically illustrates a perspective view of the tracked vehicle in FIG. 1*a* with the suspension system according to an embodiment of the present disclosure.
Figure 1B:
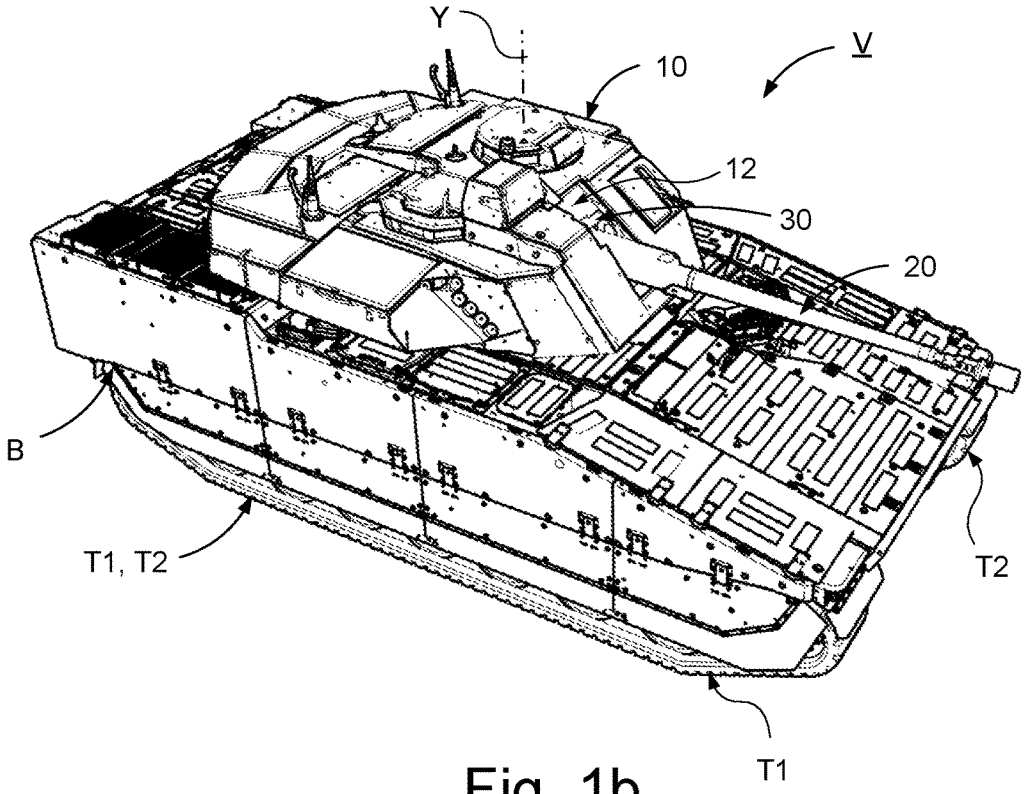

FIG. 1*a* schematically illustrates a side view of a tracked vehicle V according to an aspect of the present disclosure and FIG. 1*b* schematically illustrates a perspective view of the vehicle V in FIG. 1*a*. The exemplified vehicle 1 is constituted by a combat vehicle. The tracked vehicle V comprises a vehicle body B, which according to an aspect of the present disclosure comprises the chassis of the vehicle V and bodywork.

The tracked vehicle V comprises a track assembly pair T1, T2 being suspendedly connected to the vehicle body B. The track assembly pair comprises a right track assembly T1 and a left track assembly T2 for driving the vehicle, each track assembly comprising a drive means driven endless track E arranged to run over a set of wheels W of the track assembly.

Even if the illustrated motor vehicle 1 is a tracked vehicle the motor vehicle 1 may according to other embodiments of the invention be constituted by a wheeled vehicle.

The vehicle V is equipped with a turret 10. The turret 10 is arranged on top of the vehicle V. The turret 10 is rotatable about an axis Y of rotation orthogonal to the longitudinal extension of the vehicle V and orthogonal to the transversal extension of the vehicle V.

The vehicle V is configured to be equipped with a weapon system C having a gun barrel 20. The gun barrel 20 is mounted to the turret 10. The gun barrel 20 of the weapon system C is thus allowed to rotate by means of rotating the turret 10 about the axis Y.

The gun barrel 20 is configured to be connected to a weapon cradle 30 connected to the turret 10, a portion of the weapon cradle 30 being visible in FIG. 1*b*. The weapon cradle may be weapon cradle 30 illustrated in FIG. 3, 4*a-b*, 5*a-b* and FIG. 9. The gun barrel 20 is configured to be raised and lowered, i.e. provide an elevation movement, about an elevation axis Z1, illustrated in FIG. 1*a*, by means of the weapon cradle.

The weapon cradle 30 is configured to be connected to a bearing support member 12 of the turret 10 so as to facilitate said elevation movement by means of the weapon cradle 30. The bearing support member 12 may be bearing support member 12 illustrated in FIGS. 3, 4*a-b* and 5*a-b*.

Figure 2:
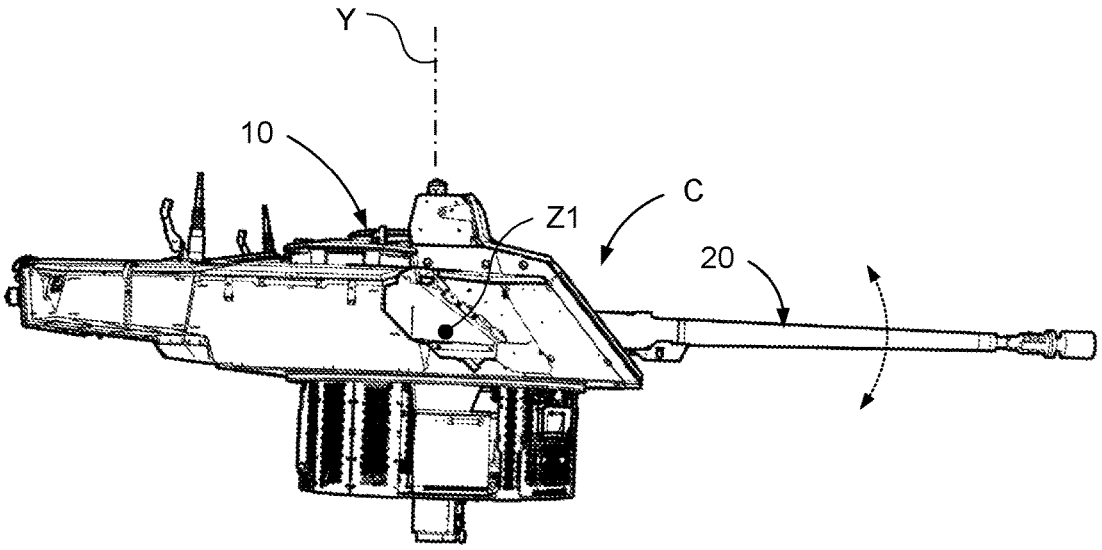
FIG. 2 schematically illustrates a side view of a turret with a weapon system having a gun barrel according to an embodiment of the present disclosure.

FIG. 2 schematically illustrates a side view of the turret 10 with the weapon system C having a gun barrel 20 according to an embodiment of the present disclosure.

As mentioned above with reference to FIG. 1*a-b*, the gun barrel 20 is configured to be connected to a weapon cradle, e.g. a weapon cradle 30 illustrated in FIGS. 3, 4*a-b* and 5*a-b*. The gun barrel 20 is configured to be raised and lowered, i.e. provide an elevation movement, about an elevation axis Z1 by means of the weapon cradle.

Figure 3:
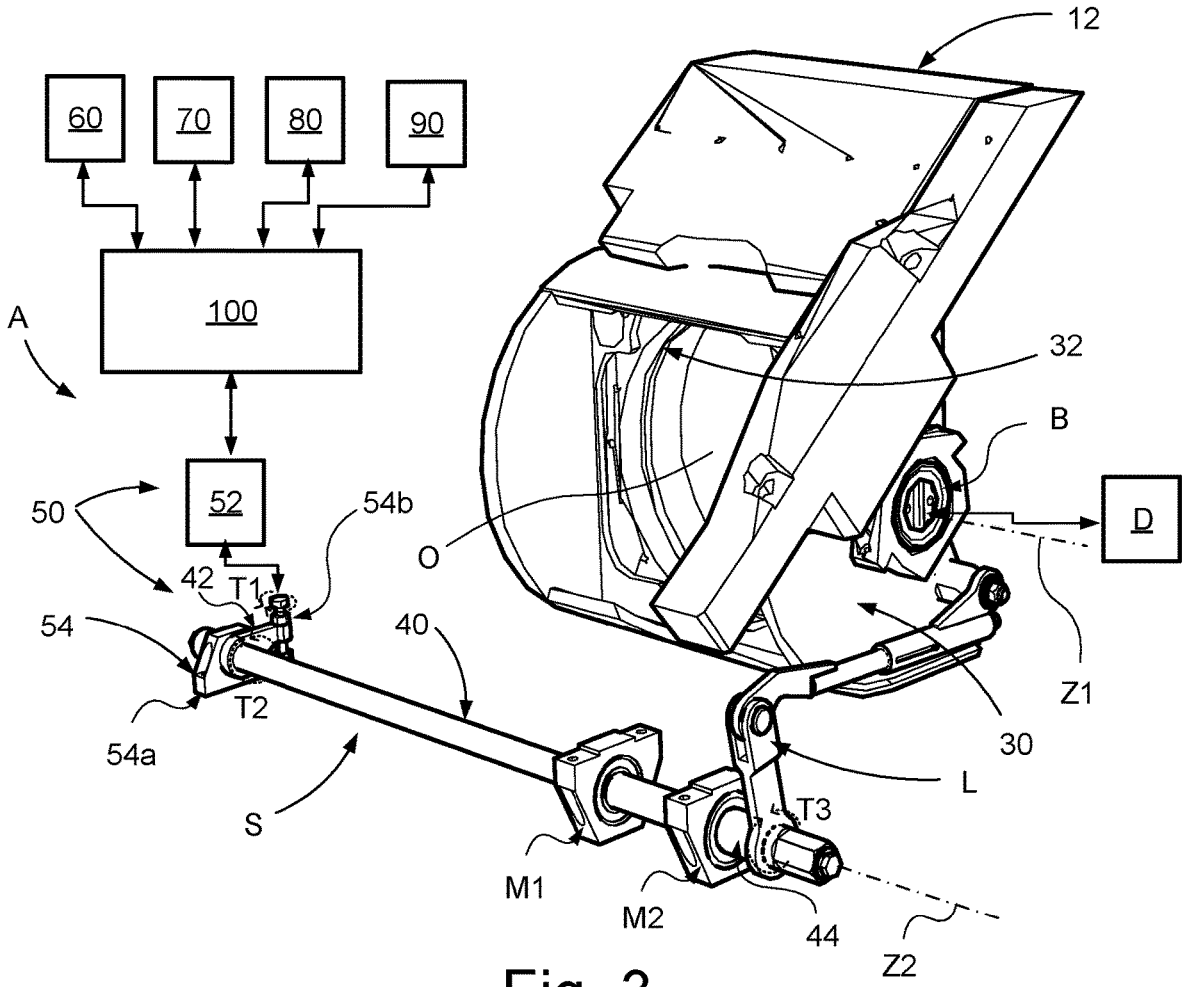
FIG. 3 schematically illustrates a perspective view of a weapon cradle equipped with an arrangement for balancing a gun barrel of a vehicle mounted weapon system according to an embodiment of the present disclosure.
Figure 4A:
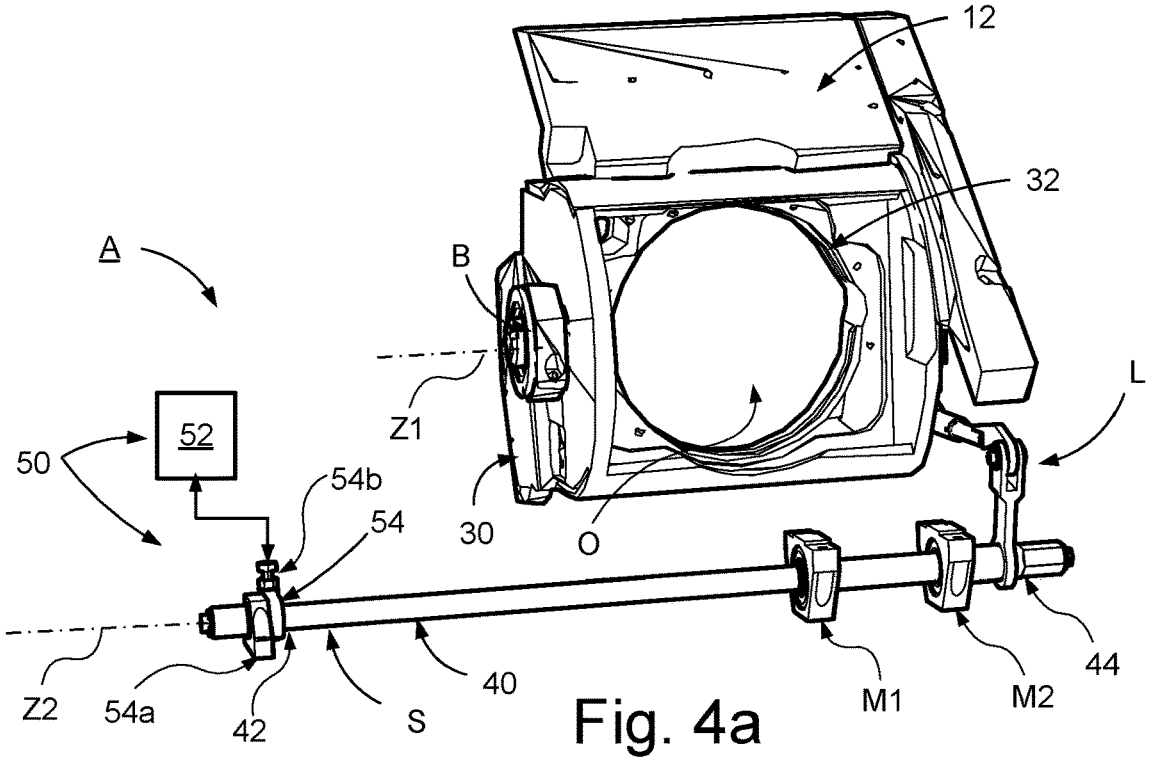
FIG. 4*a* schematically illustrates a front perspective view of the weapon cradle and arrangement in FIG. 3.
Figure 4B:
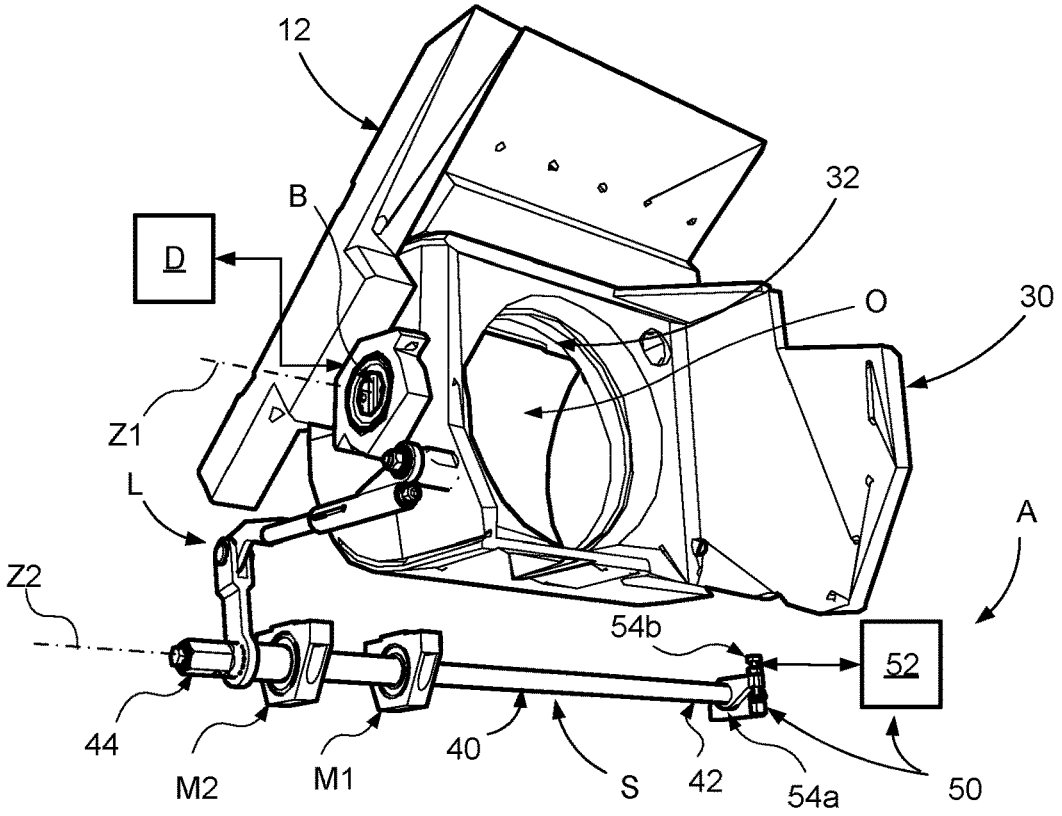
FIG. 4*b* schematically illustrates a rear perspective view from the underside of the weapon cradle and arrangement in FIG. 3.
Figure 5A:
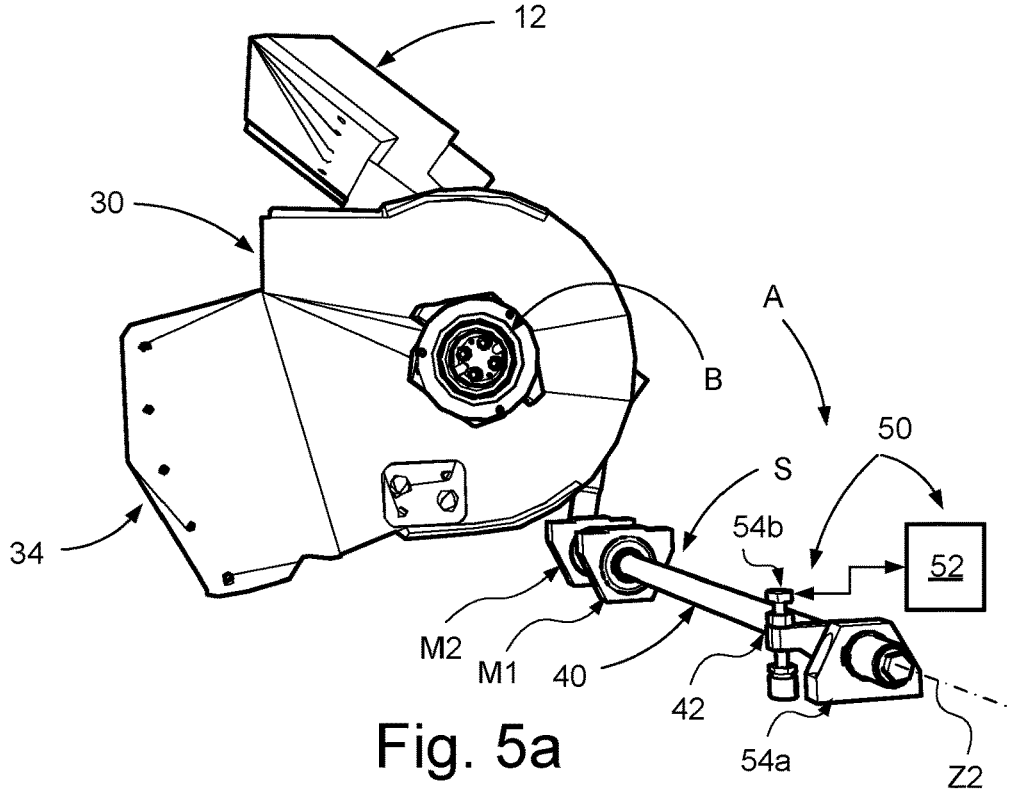
FIG. 5*a* schematically illustrates a side perspective view of the weapon cradle and arrangement in FIG. 3.
Figure 5B:
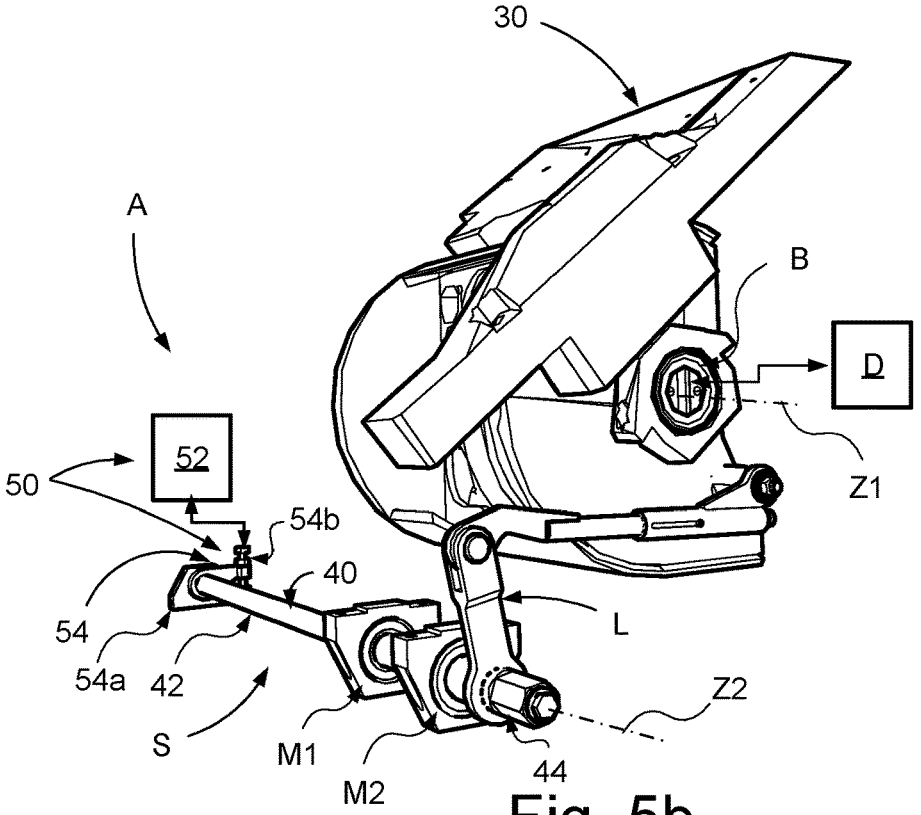
FIG. 5*b* schematically illustrates a side perspective view of the weapon cradle and arrangement in FIG. 3.

FIG. 3 schematically illustrates a perspective view of a weapon cradle 30 equipped with an arrangement A for balancing a gun barrel of a vehicle mounted weapon system according to an embodiment of the present disclosure; and FIGS. 4*a-b* and 5*a-b* schematically illustrates different perspective views of the weapon cradle and arrangement in FIG. 3.

The weapon cradle 30 is arranged to allow elevation movement of a gun barrel, e.g. a gun barrel as described with reference to FIG. 1*a-b* and FIG. 2. The weapon cradle 30 is arranged to allow elevation movement of a gun barrel about an elevation axis Z1.

The weapon cradle 30 is according to an aspect of the present disclosure configured to be attached to the turret 10 and thus configured to be rotated with the turret about the axis Y as illustrated in FIG. 1*a-b* and FIG. 2.

The weapon cradle 30 comprises a ring shaped support member 32 for supporting the gun barrel. The ring shaped support member 32 has an opening O through which the gun barrel is intended to be arranged. The opening O of the ring shaped support member 32 has an extension corresponding to the extension of the gun barrel when mounted to the ring shaped support member 32. The elevation axis Z1 is arranged in connection to the ring shaped support member 32. The elevation axis Z1 is orthogonal to the axial extension of the opening O and hence the axial extension of the gun barrel.

The weapon cradle 30 with the ring shaped support member 32 with the opening O is configured to be journaled in bearings B for facilitating rotation of the weapon cradle 30 about the axis Z1 for elevation of the gun barrel when supported by the weapon cradle 30.

The weapon cradle 30 is thus configured to be connected to the turret via said bearings B so as to facilitate rotation of the weapon cradle 30 relative to the turret, i.e. about the axis Z1. The weapon cradle 30 is configured to be connected to a bearing support member 12 of the turret via said bearings B so as to facilitate rotation of the weapon cradle 30 relative to the turret, i.e. about the axis Z1.

The weapon cradle 30 comprises or is operably connected to a drive arrangement D for operating the weapon cradle 30. The drive arrangement D for operating the weapon cradle 30 is configured to move the gun barrel about the elevation axis Z1. The drive arrangement D for operating the weapon cradle 30 is thus configured to rise or lower the gun barrel about the elevation axis Z1. The drive arrangement D for operating the weapon cradle 30 is thus configured to provide a rotating movement of the weapon cradle 30 about the elevation axis Z1. The drive arrangement D may be any suitable drive arrangement. The drive arrangement D is according to an aspect of the present disclosure an electric motor, e.g. a servomotor. The drive arrangement D may be fixedly arranged to the turret. The drive arrangement D may be configured to transfer the power via a sprocket segment of the weapon cradle 30 for operating the weapon cradle 30, i.e. move the weapon cradle 30 about the axis Z1. Such a sprocket segment, not shown, may be arranged on a side portion 34 shown in FIG. 5*a*. Such a sprocket segment, not shown, arranged on the side portion 34 shown in FIG. 5*a*, may have an arc shaped configuration so as to facilitate movement of the weapon cradle 30 about the axis Z.

The weapon cradle 30 is thus equipped with an arrangement A for balancing the gun barrel during vehicle operation when required. The weapon cradle 30 may comprise or be operably connected to the arrangement A for balancing the gun barrel.

Said arrangement A comprises a suspension system S configured to provide a torque opposing imbalance of the gun barrel. According to an aspect of the present disclosure illustrated in e.g. FIG. 3, the suspension system S comprises a torsion bar 40. The torsion bar 40 has a first end portion 42 configured to be fixedly attached to the turret and a second end portion 44 configured to be connected to the weapon cradle 30 so as to provide said torque. The torsion bar 40 is thus according to an aspect of the present disclosure configured to provide a torque opposing imbalance of the gun barrel. The torsion bar 40 is according to an aspect of the present disclosure configured to be pre-tensioned so as to oppose imbalance of the gun barrel. The torsion bar 40 is according to an aspect of the present disclosure configured to be pre-tensioned so as to provide said torque opposing imbalance of the gun barrel.

The torsion bar 40 is configured to be connected to the weapon cradle 30 at its second end portion 44 via a link arrangement L. The link arrangement L is connected at a first end to the torsion bar 40 in connection to the second end portion 44 and at a second end to the axis Z1 in connection to the bearings B on the left side of the weapon cradle 30. The link arrangement L is according to an embodiment configured to provide a certain lever function so as to balance the weapon cradle 30.

The torsion bar 40 is configured to be supported by a pair of support members M1, M2. The pair of support members M1, M2 comprises a first support member M1 arranged around the torsion bar 40 between the first end portion 42 and second end portion 44. The pair of support members M1, M2 comprises a second support member M2 arranged around the torsion bar 40 between the first support member M1 and the second end portion 44 at a distance from the first support member M1. The pair of support members M1, M2 are configured to be fixedly attached to the turret. The pair of support members M1, M2 are configured to be journaled in bearings around the torsion bar 40 for facilitating rotation of the torsion bar 40 relative to the pair of support members M1, M2 about the axis Z2. The torsion bar 40 may be supported and journaled by means of any suitable support member such as a single elongated member configured to support and be journaled in bearings about the torsion bar 40.

The arrangement A further comprises an adjustment device 50 for automatically adjusting the torque provided by the suspension system S based on imbalance of the gun barrel 20 so as to dynamically counteract imbalance of the gun barrel. The adjustment device 50 is according to an aspect of the present disclosure configured to automatically adjusting the pretension provided by the suspension system S based on imbalance of the gun barrel 20 so as to dynamically counteract imbalance of the gun barrel.

The adjustment device 50 is configured to provide said automatic adjustment of the torque provided by the torsion bar 40 of the suspension system S based on imbalance of the gun barrel 20 so as to dynamically counteract imbalance of the gun barrel. The adjustment device 50 is according to an aspect of the present disclosure configured to automatically adjust the pretension provided by the torsion bar 40 based on imbalance of the gun barrel 20 so as to dynamically counteract imbalance of the gun barrel.

The adjustment device 50 comprises an actuator unit 52 configured to provide said automatic adjustment of the torque provided by the suspension system S based on sensor data indicative for current imbalance of the gun barrel. The actuator unit 52 is configured to provide said automatic adjustment of the torque provided by the torsion bar 40 of the suspension system S based on sensor data indicative for current imbalance of the gun barrel. The actuator unit 52 may be any suitable actuator unit for facilitating adjustment of the torque provided by the torsion bar 40. The actuator unit 52 may according to an aspect of the present disclosure be an electric actuator, e.g. an electric motor, servomotor, step motor or the like. The actuator unit 52 may according to an aspect of the present disclosure be a servomotor. The actuator unit 52 may according to an aspect of the present disclosure be a step motor.

The actuator unit 52 may be configured to provide adjustment of the torque provided by the torsion bar 40 in any suitable way. According to an aspect of the present disclosure the actuator unit 52 is configured to provide adjustment of the torque provided by the torsion bar 40 by means of a torque adjustment device 54 arranged in connection to the torsion bar 40.

The torque adjustment device 54 comprises according to an aspect of the present disclosure a torsion bar support member 54*a* arranged around the torsion bar 40 in connection to the first end portion 42. The torsion bar support member 54*a* is configured to be fixedly attached to the turret. The first end portion 42 of the torsion bar 40 is configured to be attached to the turret by means of the support member 54*a*. The torsion bar support member 54*a* is torque adjustably arranged around the torsion bar 40 so as to provide an adjustable torque of the torsion bar 40. The torsion bar support member 54*a* is torque adjustably arranged around the torsion bar 40 in connection to the first end portion 42 so as to provide an adjustable torque of the torsion bar 40. The torsion bar support member 54*a* is arranged around the torsion bar 40 in connection to the first end portion 42 so as to provide a pretension of the torsion bar 40. The torsion bar support member 54*a* is arranged around the torsion bar 40 in connection to the first end portion 42 so as to facilitate adapting the pretension of the torsion bar 40.

The torque adjustment device 54 comprises according to an aspect of the present disclosure a torque adjustment member 54*b* for adjusting the torque of the torsion bar 40 provided by the support member 54*a*. The torque adjustment member 54*b* is according to an aspect of the present disclosure a screw joint member 54*b* attached to the support member 54*a* so as to facilitate torque adjustment of the torsion bar by screwing or unscrewing the torsion bar surrounding support member 54*a*. The torque adjustment member 54*b* is according to an aspect of the present disclosure configured to adjust pretension of the torsion bar 40.

The torque adjustment member 54*b* in the shape of a screw joint member 54*b* may thus provide a torque by screwing or unscrewing the torsion bar surrounding support member 54*a*, the torque provided by the screw joint member 54*b* being illustrated in FIG. 3 with the arrow T1.

The torque adjustment member 54*b* in the shape of a screw joint member 54*b* may thus adjust the torque of the torsion bar 40 in connection to the first end portion 42 by screwing or unscrewing the torsion bar surrounding support member 54*a*, the torque of the torsion bar 40 at the first end portion 42 being illustrated in FIG. 3 with the arrow T2.

The torque adjustment member 54*b* in the shape of a screw joint member 54*b* may thus adjust the torque provided by the torsion bar 40 by screwing or unscrewing the torsion bar surrounding support member 54*a*, the torque of the torsion bar 40 in connection to the second end portion 44 counteracting the imbalance of the gun barrel being illustrated in FIG. 3 with the arrow T3.

The actuator unit 52 is according to an aspect of the disclosure connected to the torque adjustment member 54*b* for automatically adjusting the torque provided by the suspension system based on imbalance of the gun barrel so as to dynamically counteract imbalance of the gun barrel.

The actuator unit 52 is according to an aspect of the disclosure connected to the torque adjustment member 54*b* for automatically adjusting the torque provided on the torsion bar 40 based on imbalance of the gun barrel so as to dynamically counteract imbalance of the gun barrel.

The suspension system S comprises a torsion bar 40 having a first end portion 42 configured to be fixedly attached to the turret and a second end portion configured to be connected to the weapon cradle 30 so as to provide said torque.

According to an aspect of the present disclosure the arrangement A for balancing a gun barrel 20 of a vehicle mounted weapon system is configured to be controlled by a control device 100, see FIG. 3. The arrangement A may comprise or be operably connected to the control device 100.

The control device 100 is according to an aspect of configured to control the arrangement A.

The control device 100 for controlling an arrangement A for balancing a gun barrel 20 of a vehicle mounted weapon system may be comprised in the arrangement A.

The control device 100 may be implemented as a separate entity or distributed in two or more physical entities. The control device 100 may comprise one or more computers. The control device 100 may thus be implemented or realised by the control device comprising a processor and a memory, the memory comprising instructions, which when executed by the processor causes the control device to perform the herein disclosed method.

The control device 100 may comprise one or more electronic control units, processing units, computers, server units or the like for controlling a cooling the arrangement A for balancing a gun barrel 20 of a vehicle. The control device 100 may comprise a control device such as one or more electronic control units arranged on board a vehicle. The control device 100 may comprise one or more electronic control units of the vehicle. The control device 100 may comprise one or more electronic control units, processing units, computers, server units or the like of an off-board system arranged externally to the vehicle and being operably connectable to the vehicle.

The control device 100 may according to an aspect of the present disclosure be operably connected to the actuator unit 52. The control device 100 may according to an aspect of the present disclosure be operably connected to actuator unit 52 via one or more links.

The control device 100 may according to an aspect of the present disclosure be arranged to receive sensor data indicative for current imbalance of the gun barrel.

The control device 100 may according to an aspect of the present disclosure be configured to control the actuator unit 52 based on the thus received sensor data indicative for current imbalance of the gun barrel so as to adjust the torque provided by the suspension system S, i.e. the torsion bar 40 of the suspension system S so as to dynamically counteract imbalance of the gun barrel 20.

The control device 100 is according to an aspect of the present disclosure configured to determine energy required by drive arrangement for operating the weapon cradle.

The arrangement A may comprise or be operably connected to a drive arrangement energy requirement determination device 60 for determining energy required by the drive arrangement D for operating the weapon cradle 30. The drive arrangement energy requirement determination device 60 may comprise one or more detectors for detecting required energy for operating the weapon cradle 30. Said one or more detectors for detecting required energy for operating the weapon cradle 30 may comprise an amperage consumption detector for detecting amperage consumed by the drive arrangement D, e.g. elevation drive motor. Said one or more detectors for detecting required energy for operating the weapon cradle 30 may comprise an accelerometer.

According to an aspect of the present disclosure the control device 100 is, via a link, operably connected to the drive arrangement energy requirement determination device 60. According to an aspect of the present disclosure the control device 100 is, via the link, arranged to receive signals from the device 60 representing sensor data for energy required by drive arrangement for operating the weapon cradle. The control device 100 is according to an aspect of the present disclosure configured to process the sensor data for energy required by drive arrangement for operating the weapon cradle so as to estimate current imbalance of the gun barrel.

The arrangement A may comprise or be operably connected to a gun barrel elevation determination device 70 for determining current elevation of the gun barrel. The gun barrel elevation determination device 70 may comprise one or more detectors for detecting current elevation of the gun barrel. Said one or more detectors for detecting current elevation of the gun barrel may comprise an inclination sensor and/or an angle sensor and/or an inertial sensor and/or a gyroscope and/or an encoder. Said one or more detectors for detecting current elevation of the gun barrel may comprise an accelerometer.

According to an aspect of the present disclosure the control device 100 is, via a link, operably connected to the gun barrel elevation determination device 70. According to an aspect of the present disclosure the control device 100 is, via the link, arranged to receive signals from the gun barrel elevation determination device 70 representing sensor data for current elevation of the gun barrel. The control device 100 is according to an aspect of the present disclosure configured to process the sensor data for current elevation of the gun barrel so as to estimate current imbalance of the gun barrel.

The arrangement A may comprise or be operably connected to a roll and pitch determination device 80 for determining current roll and pitch of the vehicle. The roll and pitch determination device 80 may comprise one or more detectors for detecting current roll and pitch of the vehicle. Said one or more detectors for detecting current roll and pitch of the vehicle may comprise an angle sensor and/or an inertial sensor and/or a gyroscope and/or an encoder. Said one or more detectors for detecting current roll and pitch of the vehicle may comprise an accelerometer.

According to an aspect of the present disclosure the control device 100 is, via a link, operably connected to the roll and pitch determination device 80. According to an aspect of the present disclosure the control device 100 is, via the link, arranged to receive signals from the roll and pitch determination device 80 representing sensor data for current roll and pitch of the vehicle. The control device 100 is according to an aspect of the present disclosure configured to process the sensor data for current roll and pitch of the vehicle so as to estimate current imbalance of the gun barrel.

The arrangement A may comprise or be operably connected to a gun barrel weight determination device 90 for determining current weight of the gun barrel. The gun barrel weight determination device 90 may comprise one or more weight detectors for detecting current weight of the gun barrel. The gun barrel weight determination device 90 may comprise ammunition count device for counting current ammunition of the gun barrel.

According to an aspect of the present disclosure the control device 100 is, via a link, operably connected to the gun barrel weight determination device 90. According to an aspect of the present disclosure the control device 100 is, via the link, arranged to receive signals from the gun barrel weight determination device 90 representing sensor data for current weight of the gun barrel. The control device 100 is according to an aspect of the present disclosure configured to process the sensor data for weight of the gun barrel so as to estimate current imbalance of the gun barrel.

The control device 100 may thus according to an aspect of the present disclosure be configured to process the sensor data for energy required by drive arrangement for operating the weapon cradle from the energy requirement determination device 60 and/or process the sensor data for current elevation of the gun barrel from the gun barrel elevation determination device 70 and/or process the sensor data sensor data for current roll and pitch of the vehicle from the roll and pitch determination device 80 and/or process the sensor data sensor data for weight of the gun barrel from the gun barrel weight determination device 90 so as to estimate sensor data indicative for current imbalance of the gun barrel.

According to an aspect of the present disclosure the control device 100 is, via a link, operably connected to the actuator unit 52. According to an aspect of the present disclosure the control device 100 is, via the link, arranged to send signals to the actuator unit 52 representing sensor data indicative for current imbalance of the gun barrel.

The control device 100 may according to an aspect of the present disclosure be configured to control the actuator unit 52 based on the thus received sensor data indicative for current imbalance of the gun barrel so as to adjust the torque provided by the suspension system S, i.e. the torsion bar 40 of the suspension system S so as to dynamically counteract imbalance of the gun barrel 20.

Figure 6:
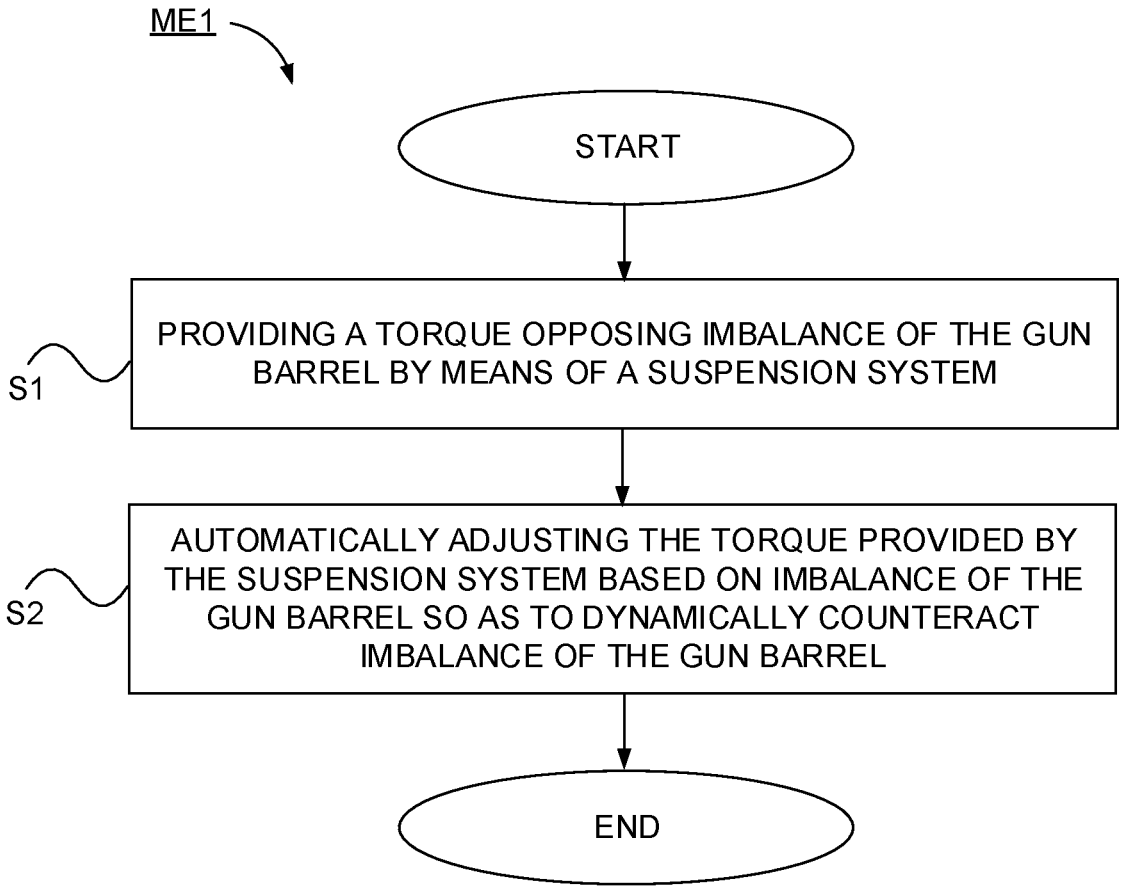
FIG. 6 schematically illustrates a flowchart of a method performed by a control device for balancing a gun barrel according to an embodiment of the present disclosure.
Figure 7:
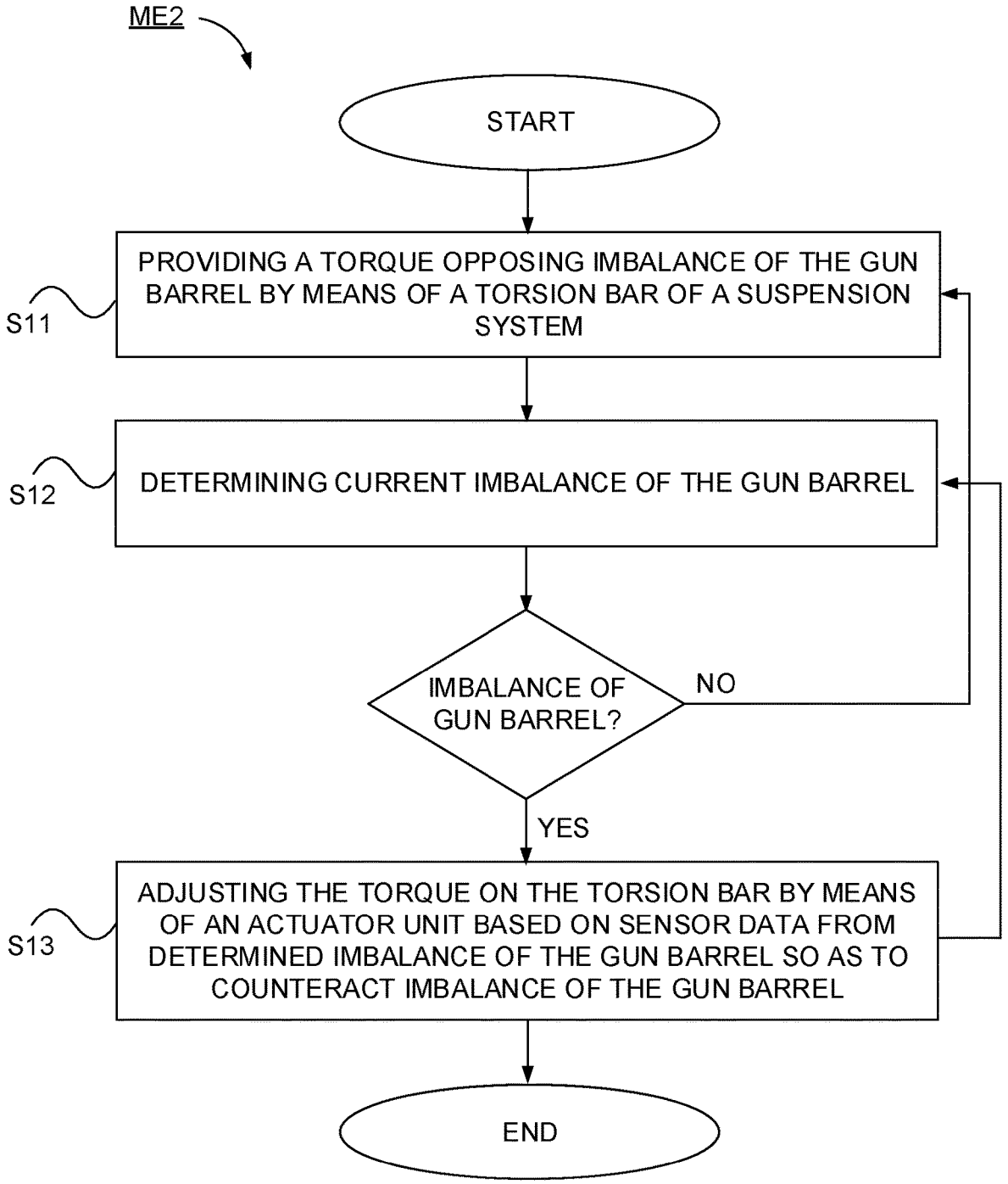
FIG. 7 schematically illustrates a flowchart of a method performed by a control device for balancing a gun barrel according to an embodiment of the present disclosure.

FIGS. 6 and 7 schematically illustrates a flowchart of a method ME1, ME2 performed by a control device for balancing a gun barrel according to an aspect of the present disclosure. The methods may be performed by means of a control device, e.g. a control device 100 as described with reference to FIG. 3. The methods may be combined in any suitable manner.

FIG. 6 schematically illustrates a flowchart of a method ME1 performed by a control device for balancing a gun barrel of a vehicle mounted weapon system according to an embodiment of the present disclosure.

The weapon system comprises the gun barrel mounted to a turret via a weapon cradle, the weapon cradle being arranged to allow elevation movement of the gun barrel about an elevation axis. The weapon system may be any suitable weapon system, e.g. a weapon system C as described with reference to FIGS. 1 and 2, and may have any suitable weapon cradle, e.g. a weapon cradle as described with reference to FIG. 3, 4*a-b*, 5*a-b*.

According to an aspect of the present disclosure, the method ME1 comprises a step S1. In this step, a torque opposing imbalance of the gun barrel is provided by means of a suspension system.

According to an aspect of the present disclosure, the method ME1 comprises a step S2. In this step, the torque provided by the suspension system is automatically adjusted based on imbalance of the gun barrel so as to dynamically counteract imbalance of the gun barrel.

FIG. 7 schematically illustrates a flowchart of a method ME2 performed by a control device for balancing a gun barrel according to an embodiment of the present disclosure.

The weapon system comprises the gun barrel mounted to a turret via a weapon cradle, the weapon cradle being arranged to allow elevation movement of the gun barrel about an elevation axis. The weapon system may be any suitable weapon system, e.g. a weapon system C as described with reference to FIGS. 1 and 2, and may have any suitable weapon cradle, e.g. a weapon cradle as described with reference to FIG. 3, 4*a-b*, 5*a-b*. A suspension system is provided comprising a torsion bar having a first end portion configured to be fixedly attached to the turret and a second end portion configured to be connected to the weapon cradle so as to provide a torque. The torsion bar may be any suitable torsion bar, e.g. a torsion bar 40 as described with reference to FIG. 3, 4*a-b*, 5*a-b*.

According to an aspect of the present disclosure, the method ME2 comprises a step S11. In this step, a torque opposing imbalance of the gun barrel is provided by means of the torsion bar of the suspension system.

According to an aspect of the present disclosure, the method ME2 comprises a step S12. In this step, current imbalance of the gun barrel is determined.

According to an aspect of the present disclosure, the method comprises the step of receiving sensor data indicative for current imbalance of the gun barrel.

According to an aspect of the present disclosure, the method comprises the step of receiving sensor data indicative for current imbalance of the gun barrel comprising receiving data for energy required by drive arrangement for operating the weapon cradle and/or receiving data for current elevation of the gun barrel and/or receiving data for current roll and pitch of the vehicle and/or receiving data for current weight of gun barrel. Said data for energy required by drive arrangement for operating the weapon cradle are sensor data from detection energy required by drive arrangement for operating the weapon cradle. Said data for current elevation of the gun barrel are sensor data from detection of current elevation of the gun barrel. Said data for current roll and pitch of the vehicle are sensor data from detection of current roll and pitch of the vehicle. Said data for current weight of gun barrel are sensor data from detection of current weight of gun barrel.

According to an aspect of the present disclosure, the method ME2 comprises a step S13. In this step, the torque on the torsion bar is adjusted by means of an actuator based on sensor data from determined imbalance of the gun barrel so as to dynamically counteract imbalance of the gun barrel.

Figure 8:
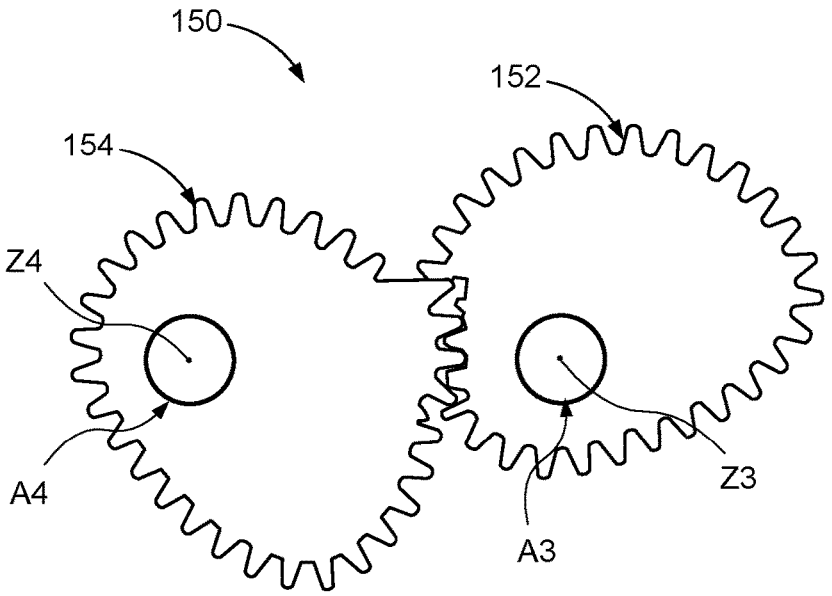
FIG. 8 schematically illustrates a progressive linkage configuration according to an embodiment of the present disclosure.

FIG. 8 schematically illustrates a progressive linkage configuration 150.

The progressive linkage configuration 150 is according to an aspect of the present disclosure configured to be comprised in the arrangement for balancing a gun barrel of a vehicle mounted weapon system according to the present disclosure. The weapon system may be a weapon system C as described with reference to FIG. 1*a-b* and FIG. 2.

Progressive linkage configuration 150 may refer to a linkage configuration 150 which is configured to mechanically provide adjustment of torque provided by the suspension system of the arrangement A based on imbalance of the gun barrel so as to counteract imbalance of the gun barrel. Progressive linkage configuration 150 may refer to a linkage configuration 150 which is configured to mechanically provide adjustment of torque provided on the torsion bar of the arrangement A based on imbalance of the gun barrel so as to counteract imbalance of the gun barrel.

The weapon system comprises the gun barrel mounted to a turret via a weapon cradle. The weapon cradle may be a weapon cradle 30 as described with reference to FIGS. 3, 4*a-b* and 5*a-b*. The weapon cradle is arranged to allow elevation movement of the gun barrel about an elevation axis Z1.

Said arrangement comprises a suspension system configured to provide a torque opposing imbalance of the gun barrel. The suspension system may be a suspension system S as described with reference to FIGS. 3, 4*a-b* and 5*a-b*. The suspension system comprises a torsion bar having a first end portion configured to be fixedly attached to the turret and a second end portion configured to be connected to the weapon cradle so as to provide said torque. The torsion bar may be a torsion bar 40 as described with reference to FIGS. 3, 4*a-b* and 5*a-b*.

The arrangement comprises an adjustment device 150 for automatically adjusting the torque provided by the torsion bar of the suspension system based on imbalance of the gun barrel so as to dynamically counteract imbalance of the gun barrel.

According to an aspect of the present disclosure illustrated in FIG. 8 the adjustment device comprises a progressive linkage configuration 152, 154 configured to provide said automatic adjustment of the torque provided by the torsion bar of the suspension system based on elevation movement of the gun barrel.

Figure 9:
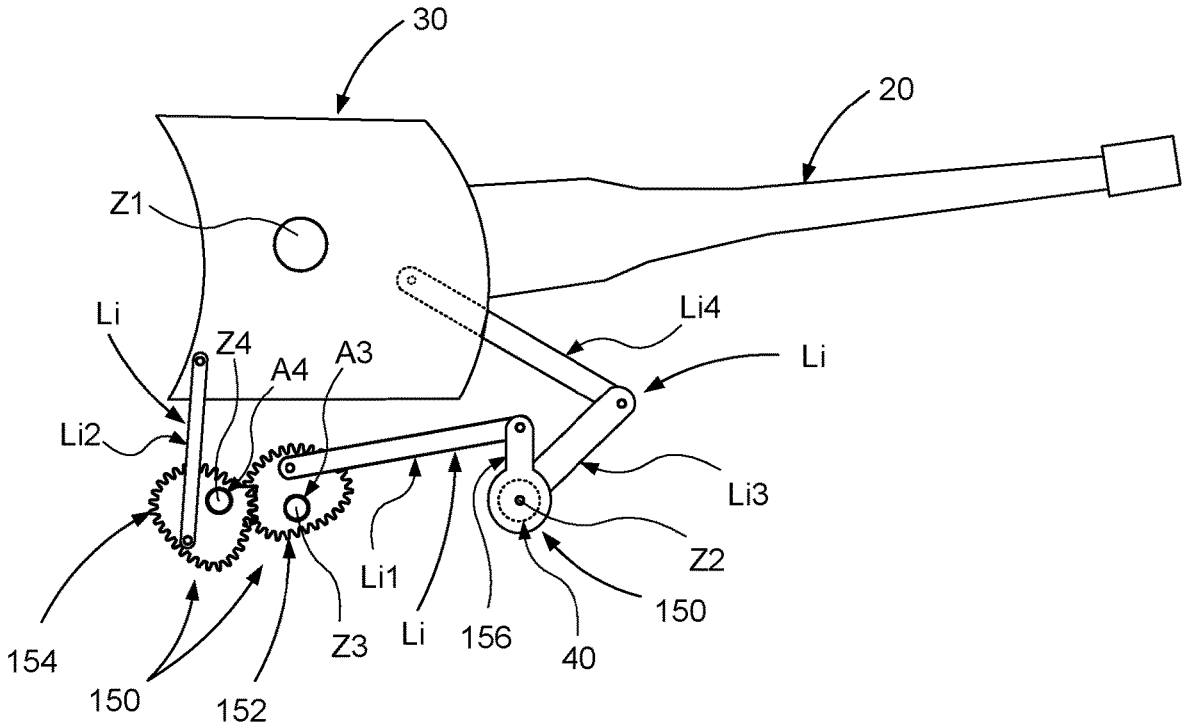
FIG. 9 schematically illustrates the progressive linkage configuration in FIG. 8 arranged in connection to a weapon cradle according to an embodiment of the present disclosure.

According to an aspect of the present disclosure the progressive linkage configuration 152, 154 comprises a first non-circular gear 152. The first non-circular gear 152 may also be denoted first non-circular gear wheel 152. The first non-circular gear 152 is configured to be attached to the torsion bar. The first non-circular gear 152 is according to an aspect of the present disclosure configured to be attached to the torsion bar via a linkage configuration, e.g. a linkage configuration as illustrated in FIG. 9. The first non-circular gear 152 is according to an aspect of the present disclosure configured to be rotatably attached about an axis Z3. The first non-circular gear 152 is according to an aspect of the present disclosure configured to be rotatably attached to a fixed axle A3 having said axis Z3 of rotation about which said first non-circular gear 152 is arranged to be rotated. The axis Z3 about which said first non-circular gear 152 is arranged to be rotated is according to an embodiment parallel to the axis Z2 of the torsion bar.

According to an aspect of the present disclosure the progressive linkage configuration 152, 154 comprises a second non-circular gear 154. The second non-circular gear 154 may also be denoted second non-circular gear wheel 154. The second non-circular gear 154 is configured to be attached to the weapon cradle in connection to the elevation axis Z1. The second non-circular gear 154 is according to an aspect of the present disclosure configured to be attached to the weapon cradle via a linkage configuration, e.g. a linkage configuration as illustrated in FIG. 9. The second non-circular gear 154 is according to an aspect of the present disclosure configured to be rotatably attached about an axis Z4. The second non-circular gear 154 is according to an aspect of the present disclosure configured to be rotatably attached to a fixed axle A4 having said axis Z4 of rotation about which said second non-circular gear 154 is arranged to be rotated. The axis Z4 about which said second non-circular gear 154 is arranged to be rotated is according to an embodiment parallel to the elevation axis Z1 of the weapon cradle.

The second non-circular gear 154 is configured to transmit torque to the first non-circular gear 152 during elevation movement of the gun barrel. See FIG. 9 schematically illustrating an exemplary embodiment FIG. 9 schematically illustrates the progressive linkage configuration 152, 154 in FIG. 8 arranged in connection to a weapon cradle 30 according to an embodiment of the present disclosure.

The progressive linkage configuration 150 is according to an aspect of the present disclosure configured to be comprised in the arrangement for balancing a gun barrel of a vehicle mounted weapon system according to the present disclosure. The weapon system may be a weapon system C as described with reference to FIG. 1*a-b* and FIG. 2.

The weapon system comprises the gun barrel 20 mounted to a turret via a weapon cradle 30. The weapon cradle may be a weapon cradle 30 as described with reference to FIGS. 3, 4*a-b* and 5*a-b*. The weapon cradle is arranged to allow elevation movement of the gun barrel 20 about an elevation axis Z1.

Said arrangement comprises a suspension system configured to provide a torque opposing imbalance of the gun barrel 20. The suspension system may be a suspension system S as described with reference to FIGS. 3, 4*a-b* and 5*a-b*. The suspension system comprises a torsion bar 40 having a first end portion configured to be fixedly attached to the turret and a second end portion configured to be connected to the weapon cradle 30 so as to provide said torque. The torsion bar may be a torsion bar 40 as described with reference to FIGS. 3, 4*a-b* and 5*a-b*.

The arrangement comprises an adjustment device 150 for automatically adjusting the torque provided by the torsion bar of the suspension system based on imbalance of the gun barrel so as to dynamically counteract imbalance of the gun barrel.

According to an aspect of the present disclosure illustrated in FIG. 9 the adjustment device 150 comprises a progressive linkage configuration 152, 154 configured to provide said automatic adjustment of the torque provided by the torsion bar 40 of the suspension system based on elevation movement of the gun barrel 20. The adjustment device 150 comprises a linkage arrangement Li for said progressive linkage configuration 152, 154.

According to an aspect of the present disclosure the progressive linkage configuration 152, 154 comprises a first non-circular gear 152. The first non-circular gear 152 may also be denoted first non-circular gear wheel 152. The first non-circular gear 152 is configured to be attached to the torsion bar 40. The first non-circular gear 152 is according to an aspect of the present disclosure configured to be attached to the torsion bar 40 via a first link Li1. The first link Li1 is according to an embodiment comprised in the linkage arrangement Li. The adjustment device 150 comprises according to an embodiment a pretension arm member 156 configured to provide a pretension of the torsion bar 40. The first non-circular gear 152 is according to an aspect of the present disclosure configured to be attached to the pretension arm member 156, and hence torsion bar 40, via said first link Li1. The first link Li1 is thus according to an embodiment configured to be linked to the pretension arm member 156.

The first non-circular gear 152 is according to an aspect of the present disclosure configured to be rotatably attached about an axis Z3. The first non-circular gear 152 is according to an aspect of the present disclosure configured to be rotatably attached to a fixed axle A3 having said axis Z3 of rotation about which said first non-circular gear 152 is arranged to be rotated. The axis Z3 about which said first non-circular gear 152 is arranged to be rotated is according to an embodiment parallel to the axis Z2 of the torsion bar.

According to an aspect of the present disclosure the progressive linkage configuration 152, 154 comprises a second non-circular gear 154. The second non-circular gear 154 may also be denoted second non-circular gear wheel 154. The second non-circular gear 154 is configured to be attached to the weapon cradle in connection to the elevation axis Z1. The second non-circular gear 154 is according to an aspect of the present disclosure configured to be attached to the weapon cradle via a second link Li2. The second link Li2 is according to an embodiment comprised in the linkage arrangement Li.

The second non-circular gear 154 is according to an aspect of the present disclosure configured to be rotatably attached about an axis Z4. The second non-circular gear 154 is according to an aspect of the present disclosure configured to be rotatably attached to a fixed axle A4 having said axis Z4 of rotation about which said second non-circular gear 154 is arranged to be rotated. The axis Z4 about which said second non-circular gear 154 is arranged to be rotated is according to an embodiment parallel to the elevation axis Z1 of the weapon cradle.

The second non-circular gear 154 is configured to transmit torque to the first non-circular gear 152 during elevation movement of the gun barrel.

Thus, when there is an elevation movement of the gun barrel 20, i.e. when the weapon cradle 30 rotates about the elevation axis Z1, the second non-circular gear 154 is rotated about the axis Z4 by means of the second link Li2.

The first non-circular gear 152 being engaged with the second non-circular gear 154 is then rotated about the axis Z3 by means of the second non-circular gear 154. Due to the configuration of said progressive linkage configuration 152, 154, i.e. due to the non-circular shape of the gears, 152, 154, the first non-circular gear 152 will rotate with the second non-circular gear 154, but with a different angle depending on the rotation about the elevation axis Z1.

The first non-circular gear, when rotating about the axis Z3, will then transfer the movement to the pretension arm member 156 via the first link Li1 so as to provide a certain pretension of the torsion bar 40 based on the imbalance of the gun barrel 20.

The linkage arrangement Li, according to an embodiment, comprises a link arrangement Li3, Li4 comprising a third link Li3 connected to the torsion bar 40 and a fourth link connected to the weapon cradle 30. The third link Li3 and fourth link Li4 are linked together. The link arrangement Li3, Li4 is configured to balance the weapon cradle 30. The link arrangement Li3, Li4 may according to an embodiment correspond to the link arrangement L described with reference to FIGS. 3, 4*a-b* and 5*a-b*.

The foregoing description of the preferred embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated.

The invention claimed is:

1. An arrangement for balancing a gun barrel of a vehicle mounted weapon system, the weapon system comprising the gun barrel mounted to a turret via a weapon cradle, the weapon cradle being arranged to allow elevation movement of the gun barrel about an elevation axis, said arrangement comprising a suspension system, wherein the suspension system comprises a torsion bar having a first end portion and a second end portion configured to be connected to the weapon cradle, the torsion bar being configured to provide a pretension torque opposing imbalance of the gun barrel, the arrangement comprising an adjustment device for adjusting the torque provided by the torsion bar of the suspension system based on imbalance of the gun barrel, the adjustment device comprises: a torque adjustment device arranged in connection to the torsion bar, wherein the torque adjustment device comprises: a torsion bar support member around the first end portion of the torsion bar and configured to be fixedly attached to the turret; and a torque adjustment member configured to adjust the torsion bar support member so as to apply torque on the torsion bar; and an actuator unit configured to adjust, based on sensor data indicative of current imbalance of the gun barrel so as to dynamically counteract imbalance of the gun barrel, the torque adjustment member so that the torsion bar support member applies the torque on the torsion bar.

2. The arrangement according to claim 1, wherein the sensor data indicative for current imbalance of the gun barrel comprises one or more of energy required by drive arrangement for operating the weapon cradle, current elevation of the gun barrel, current roll and pitch of the vehicle, and current weight of gun barrel.

3. The arrangement according to claim 1, comprising a control device configured to control the adjustment device based on said sensor data indicative for current imbalance of the gun barrel.

4. A method performed by a control device for balancing a gun barrel of a vehicle mounted weapon system, the weapon system comprising the gun barrel mounted to a turret via a weapon cradle, the weapon cradle being arranged to allow elevation movement of the gun barrel about an elevation axis, the method comprising the step of providing a pretension torque opposing imbalance of the gun barrel by a suspension system, wherein the suspension system comprises a torsion bar having a first end portion and a second end portion configured to be connected to the weapon cradle so as to provide said torque, characterized by the step of:

determining current imbalance of the gun barrel; and automatically adjusting the torque on the torsion bar by an actuator unit and a torque adjustment device based on sensor data from the thus determined imbalance of the gun barrel so as to dynamically counteract imbalance of the gun barrel, wherein the torque adjustment device comprises:

a torsion bar support member around the first end portion of the torsion bar and configured to be fixedly attached to the turret; and a torque adjustment member configured to adjust the torsion bar support member so as to apply torque on the torsion bar, wherein the actuator unit is configured to adjust, based on sensor data indicative of current imbalance of the gun barrel so as to dynamically counteract imbalance of the gun barrel, the torque adjustment member so that the torsion bar support member applies the torque on the torsion bar.

5. The method according to claim 4, wherein the step of determining current imbalance of the gun barrel comprises one or more of the steps of: determining energy required by a drive arrangement for operating the weapon cradle; detecting current elevation of the gun barrel; detecting current roll and pitch of the vehicle; and, determining current weight of gun barrel.

6. A vehicle comprising an arrangement for balancing a gun barrel of a weapon system mounted on the vehicle according to claim 1.

7. The vehicle according to claim 6, wherein the vehicle is a tracked vehicle.

* * * * *